United States Patent [19]

Prentice

[11] 4,375,367

[45] Mar. 1, 1983

[54] LOWER POWER, FREON REFRIGERATION ASSISTED AIR SEPARATION

[75] Inventor: Alan L. Prentice, Surbiton, England

[73] Assignee: Air Products and Chemicals, Inc., Allentown, Pa.

[21] Appl. No.: 255,910

[22] Filed: Apr. 20, 1981

[51] Int. Cl.[3] ..... F25J 3/04

[52] U.S. Cl. ..... 62/13; 62/18; 62/38; 62/40

[58] Field of Search ..... 62/13–15, 62/40, 38, 18

[56] References Cited

U.S. PATENT DOCUMENTS

| | | | |
|---|---|---|---|
| 3,079,759 | 3/1963 | Schilling | 62/29 |
| 3,091,094 | 5/1963 | Becker | 62/24 |
| 3,492,828 | 2/1970 | Ruckborn | 62/13 |
| 4,152,130 | 5/1979 | Theobald | 62/18 |

OTHER PUBLICATIONS

R. E. Lattimer, "Distillation of Air", Feb. 1967, appearing in Chemical Engineering Process, vol. 63, No. 2, pp. 35–59.

*Primary Examiner*—Norman Yudkoff

*Attorney, Agent, or Firm*—Geoffrey L. Chase; E. Eugene Innis; James C. Simmons

[57] ABSTRACT

Liquid oxygen and liquid nitrogen are produced from the separation of air in an installation of reduced size wherein the refrigeration necessary for the operation of the air separation unit is produced from the use of a single compander and a freon refrigeration unit affixed to a split-out stream of the main heat exchanger with appropriate recycling and heat exchange. The process for such an installation is also set forth.

5 Claims, 3 Drawing Figures

LOWER POWER, FREON REFRIGERATION ASSISTED AIR SEPARATION

TECHNICAL FIELD

This invention relates to the production of liquid oxygen and liquid nitrogen in an air separation system of relatively small capacity. The demand for the components of air in their separated form exists for both large volume demand and relatively smaller volume demand. This invention is directed to a system commensurate with relatively smaller volume demand. Therefore, this system is designed for economies of size and capital expenditure, as well as economies in operation due to the low specific power required to operate such a system.

BACKGROUND OF THE PRIOR ART

Generally, installations for producing relatively smaller volumes of separated air components, namely units processing less than 100 tons of product per day, are not cost effective when designed with the two sets of tandem compressor and expander used in large volume installations, namely above 100 tons per day and up to 1,000 tons per day.

In U.S. Pat. No. 4,152,130, an installation is disclosed which utilizes two sets of tandem compressors and expanders to supply refrigeration for the separation of air into its major components, nitrogen and oxygen. This installation operates in the over 100 ton per day category.

U.S. Pat. No. 3,492,828 discloses an installation for the separation of gas mixtures wherein a single tandem compressor and expander is utilized to cool a feed gas stream by indirect heat exchange rather than by direct expansion of the gas feed stream. Additional expansion valves and heat exchangers are utilized for supplemental refrigeration.

U.S. Pat. No. 3,091,094 teaches the utilization of a split-out stream from a heat exchange unit in an air separation installation. The split-out stream is not utilized to further refrigerate the feed air stream of the installation.

U.S. Pat. No. 3,079,759 discloses an air separation unit wherein a portion of the feed air stream is split out from the main heat exchanger and refrigerated by expansion through an expander prior to introduction into a distillation column. Auxiliary freon refrigeration is not set forth.

In an article authored by R. E. Lattimer entitled "Distillation of Air" appearing in Chemical Engineering Progress, Volume 63, No. 2, pages 35–59, February, 1967, various air separation units are disclosed which utilize main-line freon refrigeration units. The freon refrigeration units of this disclosure operate directly to cool the entire main feed air stream and do not operate on a split out stream or in a recycle heat exchange relationship.

Therefore, it is an object of the present invention to provide the necessary refrigeration of the feed air stream to an air separation unit of relatively smaller capacity, wherein the refrigeration is derived from air stream expansion means as well as direct in-line freon refrigeration means on a split-out stream of the feed air stream; wherein refrigeration is performed on at least a portion of an air stream without indirect heat exchange or the use of secondary heat exchange fluids. This invention is directed to air separation in the range of 20 to 100 tons per day (T/D) of liquid product and preferably 30 to 60 T/D.

BRIEF SUMMARY OF THE INVENTION

The present invention provides a method for producing liquid oxygen and liquid nitrogen in an air separation system of relatively smaller capacity wherein the process is comprised of the steps of compressing an initial feed air stream, separating carbon dioxide and water from said compressed feed air stream, compressing the separated feed air stream in at least one recycle compressor, further compressing the air stream in the compressor end of a single tandem compressor and expander, cooling the air stream initially in a main heat exchanger, further cooling at least a portion of the initially cooled air stream by heat exchange of said air stream with a freon refrigeration unit, dividing the cooled feed air stream into a sidestream and a remaining stream, expanding the sidestream to a lower temperature and pressure and cooling said remaining stream in heat exchange relationship with at least a portion of said expanded sidestream, injecting the cooled remaining stream into a distillation, column, recycling at least a portion of said expanded sidestream to said recycle compressor, separating the remaining stream in said distillation column and producing both liquid oxygen and liquid nitrogen in said column.

Preferably, the expanded sidestream can be split into two streams in order that a portion of said sidestream can be delivered to the distillation column of the air separation unit, while a second portion of the expanded sidestream is recycled in order to provide refrigeration in the main heat exchanger for the incoming feed air stream.

Optionally, all of the initial feed air stream which is cooled in the main heat exchanger is diverted from the main heat exchanger and is further cooled by the freon refrigeration unit.

The process may also include, advantageously, an auxiliary heat exchanger to cool the remaining feed air stream subsequent to its being cooled by the main heat exchanger.

Further, it is an option to divert all of the expanded sidestream countercurrently back through the heat exchangers in order that it can be recycled through the air recycle compressor.

The present invention also provides an installation for producing liquid oxygen and liquid nitrogen wherein such installation comprises at least one compressor for compressing a feed air stream, means for separating water and hydrocarbons from said compressed air stream, at least one recycle compressor for further compressing the cleaned air stream, a compressor operated from a single tandem compressor and expander unit for further compressing the air streams, a main heat exchanger for cooling said clean compressed air stream, a freon operated rerfrigeration unit connected in heat exchange relation with at least a portion of the air stream passing through said main heat exchanger, an expander for cooling at least a portion of the cooled air stream from the main heat exchanger, means for recycling at least a portion of said expanded air stream through said main heat exchanger in order to cool the feed air stream and to mix said expanded air stream with said feed air stream, a distillation column for separating the cooled air stream into liquid nitrogen and liquid oxygen, and means for withdrawing liquid oxygen and liquid nitrogen from said distillation column.

In addition, the installation may optionally include an auxiliary heat exchanger connected in serial flow arrangement with the main heat exchanger.

In the preferred embodiment, the invention provides an air separation system which has an economic, low specific power of 680 kwh/T (kilowatt hour per liquid ton). The reduction in the amount of necessary refrigeration equipment enjoyed by the present invention design provides greater simplicity and a reduction in size of the main heat exchanger as well as reduced capital cost because of the elimination of a typical tandem compressor and expander unit used by the prior art devices. The invention pertains to a process and an installation for producing 20–100 T/D of liquid product and preferably 30–60 T/D.

DETAILED DESCRIPTION OF THE INVENTION

For a better understanding of the invention, reference will now be made to the accompanying figures of a system designed in accordance with the present invention.

Figure 1:
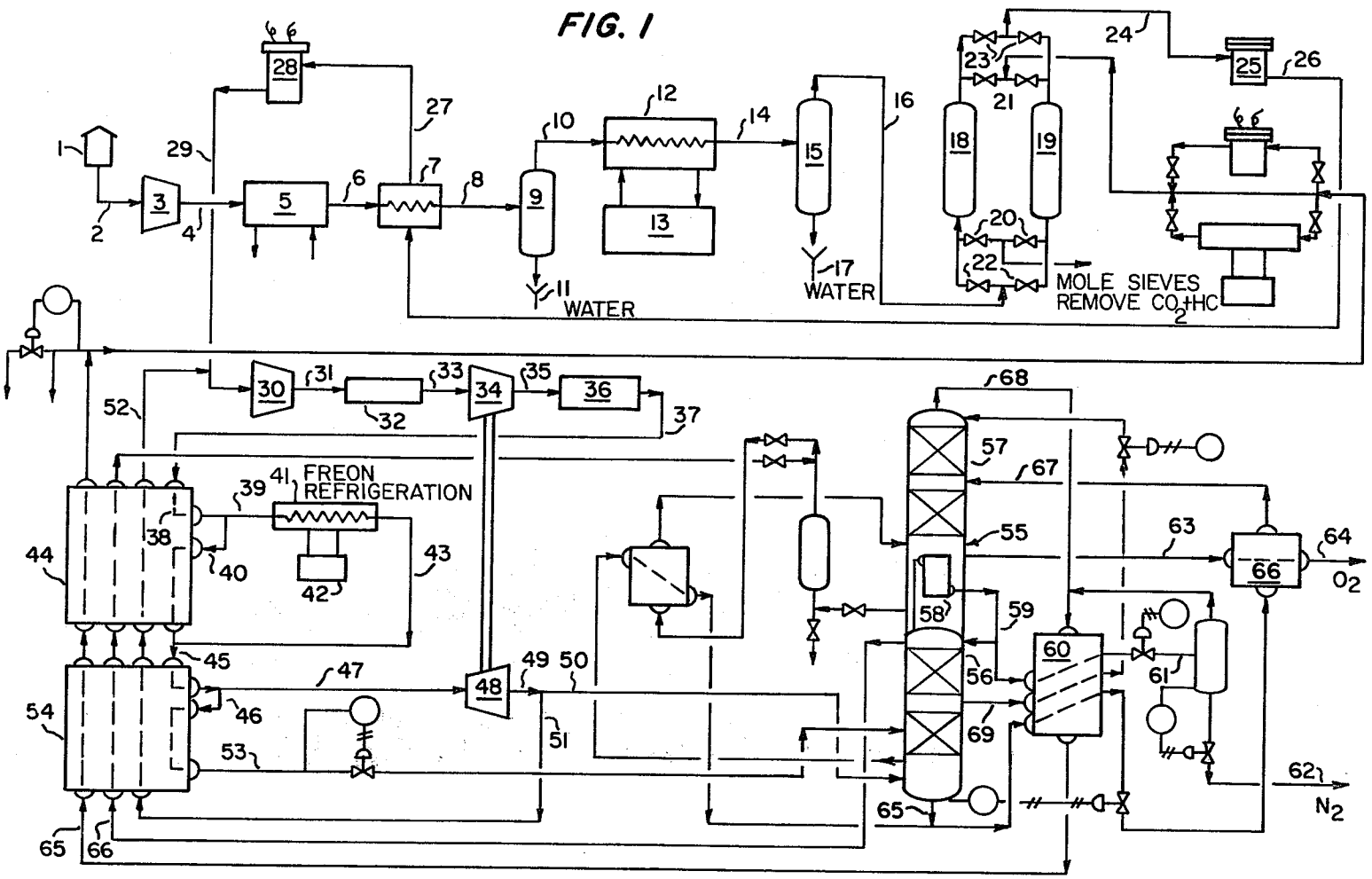
FIG. 1 is a flow scheme of an entire air separation unit incorporating the cold cycle embodiment of the present invention.

Referring to FIG. 1, atmospheric air is introduced into the system through inlet air filter 1 wherein dust and particulate matter are removed from the air prior to entering the initial air compressor 3. The compressed air emanating from compressor 3 is conducted through conduit 4 to an aftercooler 5. The aftercooler 5 is operated by heat exchanging cooling water against the heated and compressed air stream. Subsequent to this initial cooling, the air stream is conducted through conduit 6 to feed cooler 7. The feed air stream is cooled in this cooler 7 by heat exchange with air further processed in the system.

At this point, the air stream is sufficiently reduced in temperature to condense water vapor contained within the air stream. Therefore, the air stream is passed through conduit 8 to aftercooler separator 9. In this separator, the condensed moisture from the air is removed from the air stream as a bottom fraction 11. The separated air stream, in a drier condition, is led off through conduit 10 to absorber precooler 12. This cooler is operated in heat exchange with a refrigeration unit 13. The air stream emanating from this cooler in conduit 14 is approximately 39.2° F. At this point, additional moisture in the air is condensed and removed in drier condensate separator 15. Again, condensed water is removed as a bottom fraction 17 from the separator, while dried air is removed as a head fraction from the upper portion of the separator. The air stream travels through conduit 16 to switching molecular sieve driers 18 and 19. The molecular sieve driers consist of two molecular sieve beds which remove water, carbon dioxide and hydrocarbons from the air stream. These impurities are absorbed by the molecular sieve material inside the vessel, thus resulting in a clean, dry air stream. The two drier units 18 and 19 are on a staggered cycle. One bed is absorbing the contained impurities from the air stream, while the other bed is being reactivated by flushing with warm gaseous nitrogen conducted from further down the air separation system. Each drier typically has an on-stream time of 2 to 12 hours after which it is taken off-stream for reactivation, and the other drier is put on-stream.

The air emanates from the molecular sieve driers through line 24 whereby it is introduced into drier filter 25, which insures that there is no carry-over of impurities or sieve components from the upstream apparatus. The cool, dry and clean air stream in line 26 is then recycled past feed cooler 7 to heat exchange with the incoming air stream in order to reduce the refrigeration load on refrigeration unit 13.

The air stream is then conducted through line 27 and defrost heater 28 to be blended with recycled air in line 29 just upstream from air recycle compressor 30. The recycled air from line 52 and the feed air from line 29 are then compressed in air recycle compressor 30 and subsequently cooled in aftercooler 32. The air stream is further compressed in the compressor end 34 of a single tandem compressor and expander unit. The tandem compressor and expander unit consists of a compressor 34 which is mechanically joined and driven by an expander 48. The compressor and expander making up the tandem compressor and expander unit are usually on the same shaft despite their functioning at different points of the stream flowpath. Again, the compressed air stream is aftercooled in cooler 36. The air stream at this point is at 92° F. and 581 psia.

The air stream is introduced into main heat exchanger 44 through line 37. After an initial flow 38 through heat exchanger 44, the air stream, in line 39, is split into two separate lines 39 and 40. The air stream in line 39 becomes a split-out sidestream, while the air stream in line 40 is conducted back through heat exchanger 44 as a remaining stream.

The air stream in line 39 is introduced into a freon refrigeration unit 41 and 42. Upon introduction of the air stream into this unit, it is at 55° F. Upon exiting from the refrigeration unit, the air stream is at −108° F. At this point, the sidestream is reintroduced into the remaining stream in order to provide a significant level of refrigeration to the combined streams. The combined stream in line 45 then enters a second heat exchanger 54. A portion of the stream is then split-out as sidestream 47, which is at a temperature of −161° F. and 583 psia. The sidestream is then expanded and further cooled in expander 48 of the single tandem compressor and expander unit. The sidestream leaves the expander 48 in line 49 at −267° F. and 98 psia. At this point, the cooled and expanded stream is split into a distillation column air feed stream in line 50 and an air recycle stream in line 51.

A remaining stream from line 45 passes through the second heat exchanger 54 in line 46. This cooled air stream is conducted to the distillation column 55 by means of line 53. The main and second heat exchangers 44 and 54 can be combined into one integral heat exchange unit.

The cooled air streams in line 50 and 53 enter the distillation column 55 in high pressure column 56. The streams are introduced into the high pressure column 56 at a point commensurate with their composition and phase. The distillation column is of a standard type wherein pure liquid nitrogen is removed from the high pressure column 56 as a head fraction at reboiler/condensor 58. The liquid nitrogen leaves the distillation column 55 through line 59 before being split into a product line and a reflux line. The reflux is reintroduced into the high pressure column 56, while the product liquid nitrogen is subcooled in heat exchanger 60, flashed to a lower temperature and conducted to a nitrogen separator through line 61. Liquid product nitrogen is removed from the bottom of the separator and is conducted to a liquid nitrogen storage unit via line 62 for further utilization. Impure reflux leaves the high pressure column 56 in line 69, is subcooled in heat exchanger 60 and introduced to the top of low pressure column 57.

Crude liquid oxygen is removed as a bottom fraction in line 65 from the high pressure column 56. It is heat exchanged several times in exchangers 60 and 66 and is then introduced into low pressure column 57 for further refinement by way of line 67. A waste nitrogen stream 68 is removed from the head of the low pressure column for heat exchange and use as a reactivative gas in the upstream equipment. A pure oxygen product is removed from the bottom of the low pressure column 57 through line 63. After heat exchange with the crude oxygen flowing from the high pressure column to the low pressure column in exchanger 66, the liquid product oxygen is transported to a liquid oxygen storage unit via line 64.

Figure 2:
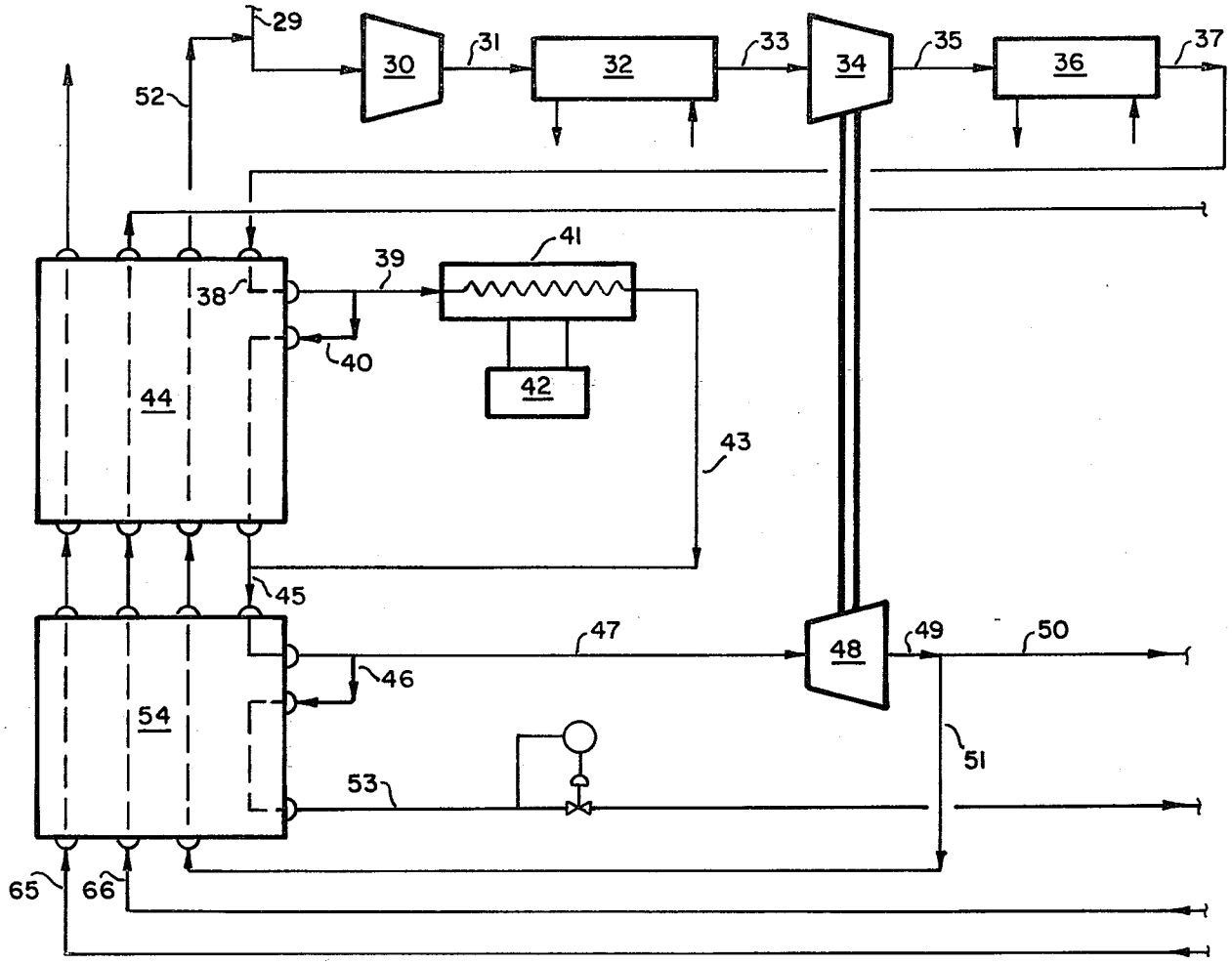
FIG. 2 is an isolation of the cold cycle embodiment of the refrigeration subsystem of the air separation unit shown in FIG. 1.

Referring to FIG. 2, wherein the heat exchange subsystem of FIG. 1 is isolated and shown in greater detail, the compressed and aftercooled air stream in line 37 enters main heat exchanger 44 wherein a portion of the stream is split-out from the heat exchanger in a sidestream 39 to be further refrigerated by a multistage freon refrigeration unit 41 and 42. This sidestream 43 is returned to the remaining stream 45 conducted through the heat exchanger 44. A second split-out sidestream 47 is removed from the remaining stream conducted through heat exchanger 54. This second split-out sidestream, at a temperature of −161° F. and a pressure of 583 psia, is expanded through the expander 48 of a single tandem compressor and expander unit to a temperature of −267° F. at 98 psia. This stream 49 is further split into line 50 which leads to the distillation column and line 51 which returns a portion of the cooled and expanded sidestream through the heat exchangers 44 and 54 countercurrently with the main remaining stream. This recycle stream 51 effectuates the refrigeration which occurs in the heat exchangers. The expanded and split air stream in line 50 can optionally be conducted through a third heat exchanger for further cooling before entering the distillation column. Such a heat exchanger is a tradeoff between increased separation efficiency and capital costs. It can be utilized depending upon the particular importance of initial cost or operational costs. Alternately, this expanded stream may be recycled in full as discussed below.

Figure 3:
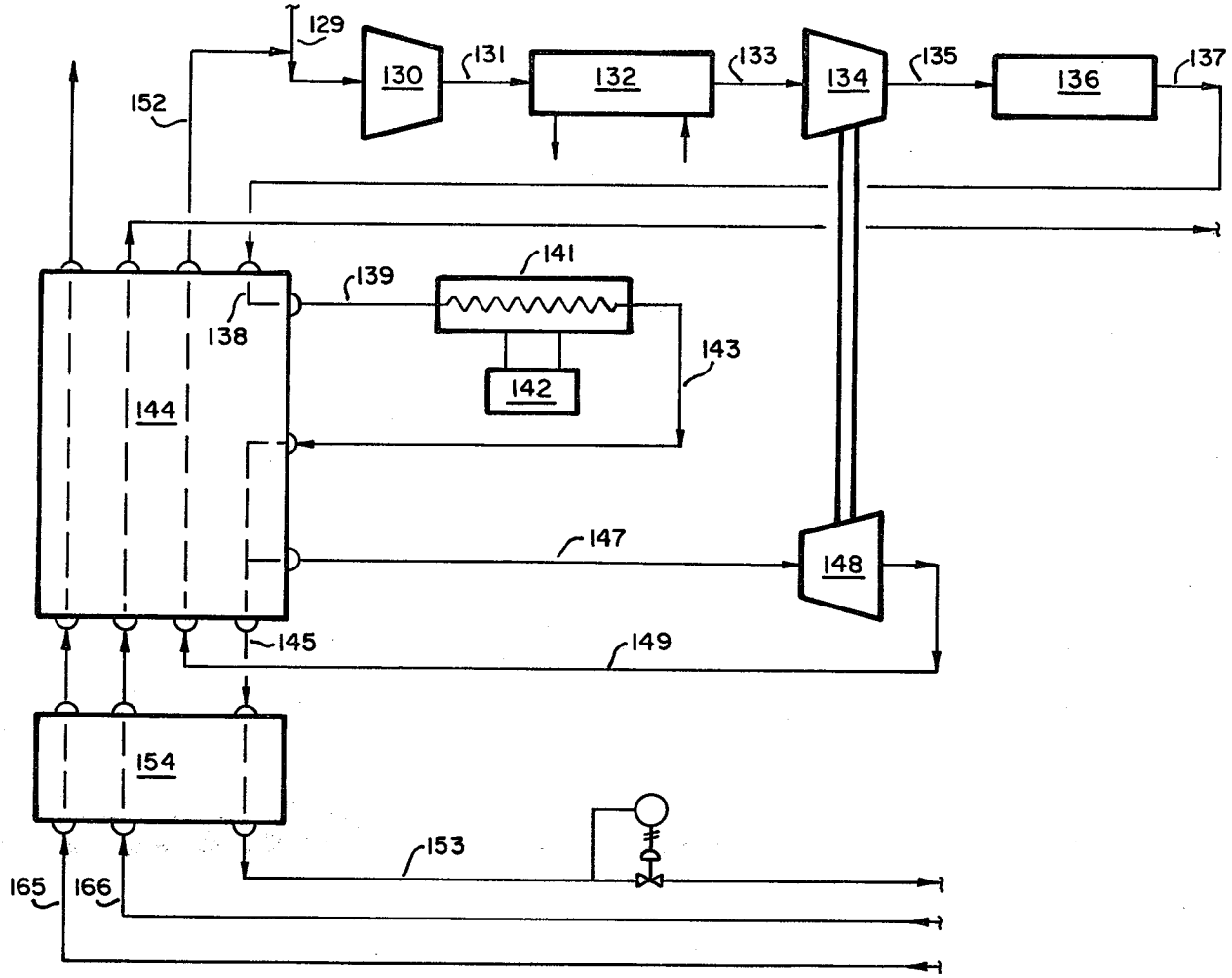
FIG. 3 is an isolation of an alternate warm air cycle embodiment for the refrigeration subsystem of the air separation unit diagramed in FIG. 1.

The alternate embodiment noted above is shown in FIG. 3. This embodiment utilizes all of the upstream apparatus above the air recycle compressor 30 as shown in FIG. 1. Continuing with FIG. 3, air is compressed in air recycle compressor 130, and aftercooled in water cooled heat exchanger 132. The air is introduced into the compressor end 134 of a single tandem compressor and expander unit and again is cooled in an aftercooler 136. The compressed air stream, now at 565 psia, is conducted along line 137 to main heat exchanger 144. At this point, the air stream is totally diverted from the heat exchanger 144 in line 139 to a single-stage freon refrigeration unit 141. This is distinguished from the embodiment shown in FIG. 2 wherein the air stream is split into a remaining stream and a sidestream. All of the air stream in this alternate embodiment is conducted through the freon refrigeration unit 141, wherein the air stream enters the exchanger at −30° F. and exits the exchanger in line 143 at −40° F. The refrigerated air stream is then further cooled in main heat exchanger 144 before being divided into a split-out sidestream 147 and a remaining stream 145. The sidestream 147, at −120° F. and 555 psia, is expanded through the expander end 148 of a single tandem compressor and expander unit to a temperature of −240° F. and a pressure of 91 psia. This expanded stream 149 is completely recycled back through the heat exchanger 144 countercurrent to the initial air stream 137. The expanded and recycled stream conducted through line 149 is introduced in line 152 to the feed air stream being conducted into the air recycle compressor 130 to complete its cyclic path. The remaining air stream in the heat exchanger 144 is conducted through line 145 to a second heat exchanger 154. This air stream is cooled to approximately −240° F. and is conducted in line 153 to the high pressure portion of the distillation column.

The embodiments discussed above provide an economic manner in which to provide an air separation installation of a relatively smaller output, in a range of 30–100 tons per day, preferably 60 tons per day, rather than the greater than 100-ton per day installations of the prior art. Reduced capital outlay and installation size reduction are achieved without the use of cascade, double refrigeration provided by dual tandem compressor and expander apparatus. Rather, the refrigeration necessary to operate the air separation unit and particularly the distillation column of this invention, is achieved by the tandem operation of an in-line single tandem compressor and expander unit and an in-line freon refrigeration unit. Alternately, the freon refrigeration unit may provide a relatively large amount of refrigeration or a relatively minor amount of refrigeration. In the event that a large amount of refrigeration is supplied by the freon refrigeration unit, a portion of the expanded and refrigerated sidestream may be directed to the distillation column rather than being entirely recycled for refrigeration purposes through the main heat exchanger. Therefore, only a portion of the refrigerated recycle stream is needed to provide cooling to the initial air stream flowing through the heat exchanger, as shown in the first embodiment in FIG. 1 and 2.

However, where a low capacity freon refrigeration unit is utilized, the entire sidestream which is refrigerated and expanded is recycled through the heat exchanger in order to properly cool the air stream being fed through the heat exchanger to the distillation column of the air separation unit. These two embodiments represent a trade-off between the amount of energy input required for the freon refrigeration unit and the total amount of refrigerated air available for introduction into the distillation column, and not necessary for refrigerative heat exchange.

Various modifications to the installation described with reference to the accompanying figures are envisioned without departing from the scope of the invention, for example in FIG. 2 an additional heat exchanger may be utilized below heat exchanger 54.

What is claimed is:

1. A process for separating air for the recovery of 30 to 60 tons of product per day in the form of liquid oxygen and liquid nitrogen comprising the steps of:

(a) compressing an initial feed air stream;

(b) separating carbon dioxide and water from said compressed feed air stream;

(c) compressing the separated feed air stream and a recycle air stream in a recycle compressor;

(d) further compressing the air stream in a single compressor which is mechanically driven by a single expander;

(e) cooling the air stream initially in a main heat exchanger against product streams and a single expanded recycle stream;

(f) further cooling a portion of the initially cooled air stream passing through said heat exchanger by removing a split-out sidestream from the remaining stream in the main heat exchanger and cooling it by direct heat exchange of said split-out side stream with a freon refrigeration unit;

(g) recombining the freon refrigeration cooled split-out sidestream with the remaining stream from the main heat exchanger downstream of said main heat exchanger;

(h) introducing the recombined air stream into a second heat exchanger;

(i) further dividing the cooled recombined feed air stream into a sidestream and a remaining stream which continues through said second heat exchanger for further cooling;

(j) expanding the sidestream to a lower temperature and pressure by passing it through an expander which is mechanically joined to the compressor of step (d);

(k) splitting the expanded sidestream into a feed stream to a distillation column and a recycle stream;

(l) recycling said recycle stream to said recycle compressor through the second and the main heat exchangers to provide cooling for the feed air stream and combining the recycle stream with the feed stream of step (c);

(m) cooling said remaining stream of step (i) in heat exchange relationship with said recycle stream;

(n) injecting the cooled remaining stream into said distillation column;

(o) separating the feed stream of step (k) and the remaining stream of step (n) in said distillation column and producing both liquid oxygen and liquid nitrogen in said column.

2. The invention of claim 1 wherein the liquid product output of the process is in the range of 30 to 60 tons per day.

3. The invention of claim 1 wherein the split-out stream in step (f) is cooled with freon refrigeration from approximately 50° F. to −100° F.

4. An installation for the separation of air to recover liquid oxygen and liquid nitrogen said installation having a capacity of 30–60 tons per day of product comprising;

(a) at least one compressor for compressing an initial feed air stream;

(b) means for separating water and hydrocarbons from said compressed air stream;

(c) at least one recycle compressor for together compressing the cleaned air stream and a recycle air stream;

(d) a single compressor mechanically operated from a single expander for further compressing the air streams;

(e) a main heat exchanger for cooling said clean compressed air stream against product streams and a single expanded recycle stream;

(f) a freon operated refrigeration unit connected in heat exchange relation with a split-out sidestream of the air stream passing through said main heat exchanger;

(g) a second heat exchanger for further cooling the recombined split-out stream and the remaining stream from said main heat exchanger;

(h) a single expander mechanically joined to the compressor of step d) for cooling a portion of the cooled air stream removed as a sidestream from the second heat exchanger;

(i) means for recycling a portion of said expanded air stream back through said heat exchangers in order to cool the feed air stream and to mix said expanded and recycled air stream with said feed air stream;

(j) a distillation column for separating a cooled air stream into liquid nitrogen and liquid oxygen;

(k) means for introducing a remaining cooled feed stream to said distillation column from said second heat exchanger;

(l) means for introducing a remaining expanded stream to said distillation column from said expander;

(m) means for withdrawing liquid oxygen and liquid nitrogen from said distillation column.

5. The invention of claim 4 wherein the installation has a processing capacity in the range of 30 to 60 tons per day of liquid product.

* * * * *